US010622699B2

(12) United States Patent
Nakano et al.

(10) Patent No.: US 10,622,699 B2
(45) Date of Patent: Apr. 14, 2020

(54) VEHICULAR ANTENNA APPARATUS AND CONNECTOR FOR VEHICULAR ANTENNA APPARATUS

(71) Applicant: AGC INC., Tokyo (JP)

(72) Inventors: Kazuhiro Nakano, Tokyo (JP); Shoichi Takeuchi, Tokyo (JP); Fumitaka Terashima, Tokyo (JP)

(73) Assignee: AGC INC., Tokyo (JP)

( * ) Notice: Subject to any disclaimer, the term of this patent is extended or adjusted under 35 U.S.C. 154(b) by 157 days.

(21) Appl. No.: 15/262,706

(22) Filed: Sep. 12, 2016

(65) Prior Publication Data

US 2017/0077595 A1 Mar. 16, 2017

(30) Foreign Application Priority Data

Sep. 15, 2015 (JP) ..... 2015-181476

(51) Int. Cl.
*H01Q 1/12* (2006.01)

(52) U.S. Cl.
CPC ..... *H01Q 1/1271* (2013.01)

(58) Field of Classification Search
CPC ..... H01Q 1/12; H01Q 1/1214; H01Q 1/1221; H01Q 1/1271; H01Q 1/1278; H01Q 1/1285; H01Q 1/32; H01Q 1/325; H01Q 1/3275; H01Q 1/3283; H01Q 1/3291; H01Q 1/50
See application file for complete search history.

(56) References Cited

U.S. PATENT DOCUMENTS 4,089,817 A * 5/1978 Kirkendall ..... H01Q 1/1271 343/713
4,931,806 A * 6/1990 Wunderlich ..... H01Q 1/1285 343/713
4,992,801 A * 2/1991 Saito ..... H01Q 1/1271 343/713

(Continued)

FOREIGN PATENT DOCUMENTS

CN 102449846 A 5/2012
EP 0 763 869 B1 11/2002

(Continued)

OTHER PUBLICATIONS

An Extended European Search Report dated Jan. 23, 2017 in the corresponding European Patent Application No. 16001994.9.

*Primary Examiner* — Daniel Munoz
*Assistant Examiner* — Patrick R Holecek
(74) *Attorney, Agent, or Firm* — Foley & Lardner LLP

(57) ABSTRACT

The present invention relates to a vehicular antenna apparatus including: a dielectric substrate; an antenna provided to the dielectric substrate; and a connector electrically connected to a feeding cable of a receiving apparatus, in which the antenna includes an antenna conductor provided to the dielectric substrate, and a feeding electrode electrically connected to the antenna conductor and provided on a first surface of the dielectric substrate, the connector includes a connector main body supporting the feeding cable, and a terminal electrode provided to the connector main body and electrically connected to the feeding cable, and the feeding electrode and the terminal electrode are joined via an insulating adhesive, thereby being capacitively coupled with each other.

18 Claims, 9 Drawing Sheets

(56) References Cited

U.S. PATENT DOCUMENTS

| | | | | |
|---|---|---|---|---|
| 2004/0176522 | A1* | 9/2004 | Schaetzle | C09J 11/08 524/495 |
| 2004/0178961 | A1 | 9/2004 | Maeuser et al. | |
| 2006/0096694 | A1* | 5/2006 | Zhou | B32B 17/10293 156/99 |
| 2011/0121924 | A1* | 5/2011 | White | H01P 5/028 333/260 |
| 2012/0074229 | A1 | 3/2012 | Osamura et al. | |

FOREIGN PATENT DOCUMENTS

| | | | |
|---|---|---|---|
| EP | 2 034 554 | A1 | 3/2009 |
| EP | 2 200 123 | A1 | 6/2010 |
| JP | H05-015515 | A | 2/1993 |
| JP | 5476713 | B2 | 4/2014 |

* cited by examiner

VEHICULAR ANTENNA APPARATUS AND CONNECTOR FOR VEHICULAR ANTENNA APPARATUS

FIELD OF THE INVENTION

The present invention relates to a vehicular antenna apparatus and a connector for a vehicular antenna apparatus.

BACKGROUND OF THE INVENTION

As antennas for a vehicle such as automobiles, there is, for example, known an antenna in which a linear antenna conductor is printed on a surface of a window glass or an antenna in which a linear antenna conductor is embedded in the inside of a window glass. The antenna of this kind is hereinafter referred to a glass antenna. Radio wave signals of television broadcasting, radio broadcasting, and the like are received by the antenna conductor and transmitted to a receiving apparatus such as a television receiver and a radio receiver, via a transmission line such as a coaxial cable.

A connector for electrically connecting the glass antenna and the coaxial cable to each other is disclosed in Patent Document 1 as described below. This connector includes a holder portion and a pickup portion detachably installed in the holder portion. The coaxial cable is electrically connected to the pickup portion.

Patent Document 1: Japanese Patent No. 5476713

SUMMARY OF THE INVENTION

In Patent Document 1, as a mounting method of the connector on a glass substrate, a method of fixing a terminal of the holder portion to a terminal of the glass antenna by means of soldering is adopted. In recent years, from consideration of the natural environment, it is required to avoid the use of lead for electronic devices, and the movement toward the use of an unleaded solder or a conductive adhesive for various electronic devices is being advanced. With respect to the above-described mounting method of the connector, it is also investigated to use an unleaded solder or a conductive adhesive.

However, since a melting point of a general unleaded solder is higher than a melting point of a leaded solder, if the unleaded solder is used in mounting of a connector, the treatment temperature at the time of mounting becomes high, so that there is a concern that the glass is damaged. When the glass is damaged, there is a concern that the mechanical strength of the glass is lowered. Though there is an unleaded solder having a low melting point, the unleaded solder having a low melting point involves such problems that the mechanical strength is low and that the cost is high, and so on. So far as the conductive adhesive is concerned, in general, if it is intended to obtain high conductivity, it is necessary to increase the content of a conductive material, for example, a metal such as silver. In that case, since the content of an adhesive is decreased, there is encountered such a problem that high adhesive strength is not obtained. Besides, the conductive adhesive involves such problems that the durability is low and the cost is high, and so on.

An aspect of the present invention provides a vehicular antenna apparatus capable of reducing a damage giving to a dielectric substrate and including a connector having both good mechanical strength and electric characteristic. In addition, another aspect of the present invention provides a connector for a vehicular antenna apparatus that is suitably used for the above-described vehicular antenna apparatus.

A vehicular antenna apparatus according to an aspect of the present invention includes: a dielectric substrate; an antenna provided to the dielectric substrate; and a connector electrically connected to a feeding cable of a receiving apparatus, the antenna includes an antenna conductor provided to the dielectric substrate, and a feeding electrode electrically connected to the antenna conductor and provided on a first surface of the dielectric substrate, the connector includes a connector main body supporting the feeding cable, and a terminal electrode provided to the connector main body and electrically connected to the feeding cable, and the feeding electrode and the terminal electrode are joined via an insulating adhesive, thereby being capacitively coupled with each other.

In the vehicular antenna apparatus according to an aspect of the present invention, the connector may include a holder portion having the terminal electrode, and a pickup portion detachably fitted to the holder portion and electrically connected to the feeding cable.

In the vehicular antenna apparatus according to an aspect of the present invention, the connector may be arranged while putting a predetermined gap from the first surface of the dielectric substrate, and the vehicular antenna apparatus may further include a spacer of keeping the gap between the connector and the dielectric substrate.

In the vehicular antenna apparatus according to an aspect of the present invention, the spacer may have adhesiveness.

In the vehicular antenna apparatus according to an aspect of the present invention, the insulating adhesive preferably has a dielectric constant of 4 or more.

In the vehicular antenna apparatus according to an aspect of the present invention, the insulating adhesive preferably has the dielectric constant of 10 or more.

In the vehicular antenna apparatus according to an aspect of the present invention, the insulating adhesive may contain carbon black.

In the vehicular antenna apparatus according to an aspect of the present invention, the insulating adhesive may have a volume resistivity of $10^4$ Ω·m or more.

In the vehicular antenna apparatus according to an aspect of the present invention, the insulating adhesive may have the volume resistivity of $10^{12}$ Ω·m or more.

In the vehicular antenna apparatus according to an aspect of the present invention, the insulating adhesive preferably has a shear adhesive strength of 1.0 MPa or more.

In the vehicular antenna apparatus according to an aspect of the present invention, the dielectric substrate may be a laminated glass.

A connector for a vehicular antenna apparatus according to another aspect of the present invention, includes: a connector main body supporting a feeding cable; and a terminal electrode provided on a first surface of the connector main body and electrically connected to the feeding cable, and the first surface of the connector main body and a joint surface of the terminal electrode are positioned on the substantially same plane.

In the connector for a vehicular antenna apparatus according to another aspect of the present invention, when a direction where the connector main body and the terminal electrode stand is defined as a first direction, and a direction orthogonal to the first direction is defined as a second direction, a dimension of the terminal electrode in the second direction when viewed from a normal direction of the first surface and a dimension of the connector main body in the second direction when viewed from the normal direction of the first surface may be substantially equal to each other.

In the connector for a vehicular antenna apparatus according to another aspect of the present invention, an external shape of the terminal electrode may include a curved portion.

According to an aspect of the present invention, it is possible to realize a vehicular antenna apparatus capable of reducing a damage giving to a dielectric substrate and including a connector having both good mechanical strength and electric characteristic. According to another aspect of the present invention, it is possible to realize a connector having an excellent quality and suitably used for a vehicular antenna apparatus.

DETAILED DESCRIPTION OF THE INVENTION

First Embodiment

A first embodiment of the present invention is hereunder described with reference to FIGS. 1 to 7.

In the following respective drawings, in order to make it easy to see each of constituent elements, a reduced scale of the dimensions may be sometimes made different depending upon the constituent element.

In the following description, in order to simplify writings, the "vehicular antenna apparatus" is referred to as "antenna apparatus".

In the following description, the terminologies, such as "insulating adhesive" and "pressure-sensitive adhesive double-coated tape", are used. Among these terminologies, the term "adhesive" means the matter that a material has such an action that when stuck, it is a liquid having fluidity, but thereafter, it turns to a solid and is firmly linked on the interface, thereby resisting exfoliation. On the other hand, the term "pressure-sensitive adhesive" means the matter that a material has such an action that when stuck, it is a gel-like soft solid and wets in that state on an adherend, and thereafter, it resists exfoliation without causing a change of the state. In addition, the "insulating adhesive" in the present invention means an adhesive having such a characteristic that a volume resistivity thereof is $10^4$ Ω·m or more and is different from the "conductive adhesive".

Figure 1:
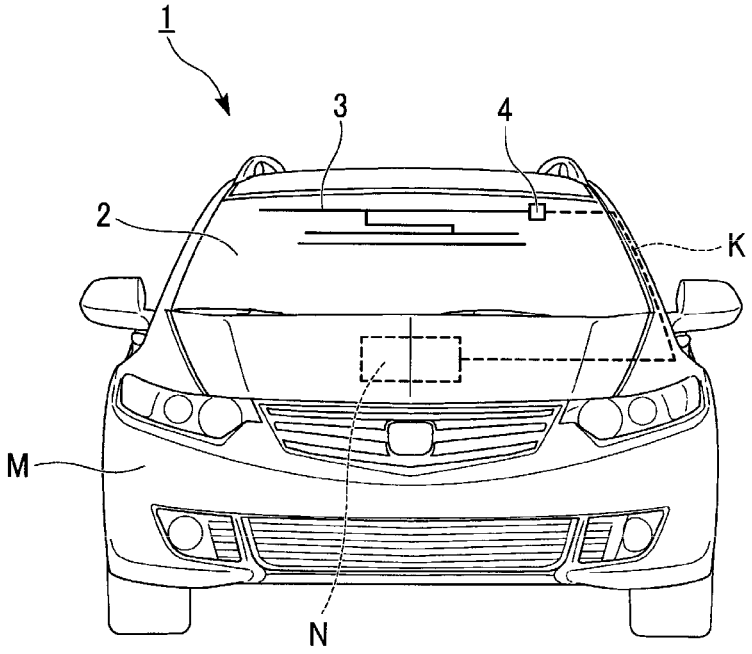
FIG. 1 is a diagrammatic configuration view of a vehicular antenna apparatus of a first embodiment of the present invention.

As shown in FIG. 1, an antenna apparatus 1 includes a window glass 2, an antenna 3, and a connector 4. The antenna apparatus 1 of the present embodiment is, for example, an antenna apparatus applied to a windshield of an automobile M. Radio wave signals of television broadcasting, radio broadcasting, and the like are received by the antenna apparatus 1 of the windshield and transmitted to a receiving apparatus N such as a television receiver and a radio receiver, via a coaxial cable K. However, the antenna apparatus of the present invention is not limited to one to be applied to the windshield but may also be one to be applied to a rear glass or a side glass.

The window glass 2 of the present embodiment is corresponding to the dielectric substrate as described in the present specification.

Figure 2:
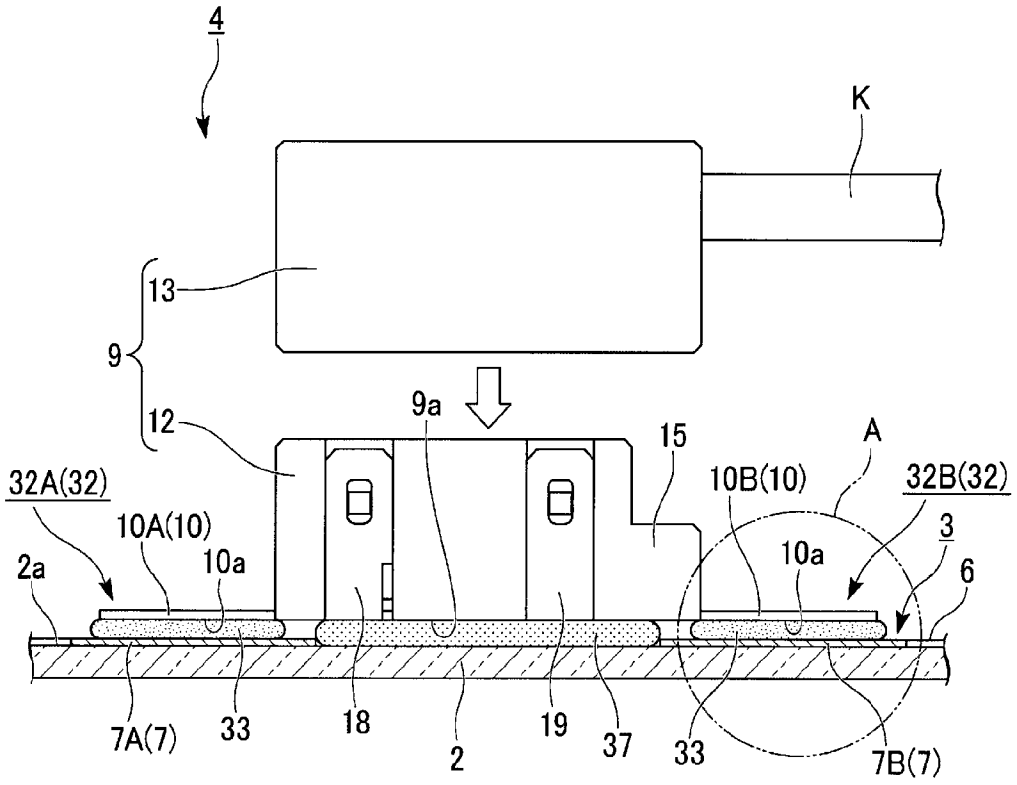
FIG. 2 is a side view of a connector in a vehicular antenna apparatus.
Figure 3:
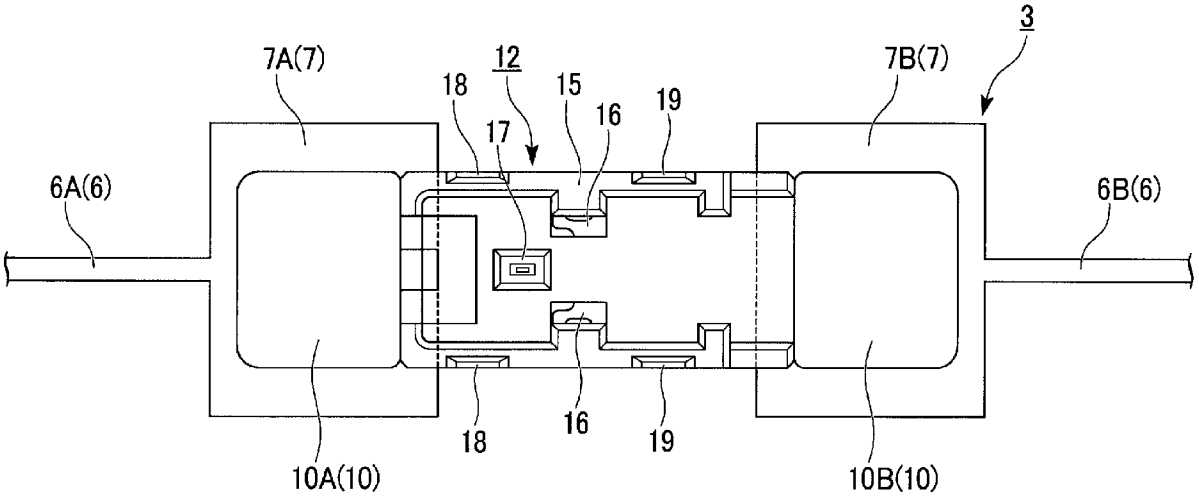
FIG. 3 is a plan view of a holder portion in a connector.

As shown in FIGS. 2 and 3, the antenna 3 is provided on a first surface 2*a* (surface on the interior side) of the window glass 2. The antenna 3 includes an antenna conductor 6 and a feeding electrode 7. The antenna conductor 6 and the feeding electrode 7 are integrally constituted and provided on the first surface 2*a* of the window glass 2. Accordingly, the antenna conductor 6 and the feeding electrode 7 are electrically connected to each other. The antenna conductor 6 and the feeding electrode 7 are constituted of a conductive material such as silver and copper. In the case of the present embodiment, the antenna conductor 6 and the feeding electrode 7 are constituted of a silver pattern formed on the first surface 2*a* of the window glass 2. Though the antenna conductor 6 and the feeding electrode 7 are formed through a step, such as silver paste printing and baking, the forming method of the antenna conductor 6 and the feeding electrode 7 is not limited thereto.

The antenna conductor 6 and the feeding electrode 7 may not always be provided on the first surface 2*a* of the window glass 2. That is, in the case where the window glass 2 is a laminated glass shown in FIG. 4, the antenna conductor 6 and the feeding electrode 7 may be provided in the inside of the laminated glass (surface coming into contact with a resin layer 2B). In FIG. 2, though illustration is omitted, a picture frame-like black ceramic layer is provided on the first surface 2*a* of the window glass 2. A part or the whole of the connector 4, the antenna conductor 6 and the feeding electrode 7 may be provided on the black ceramic layer. When viewed from the vehicle exterior side of the window glass 2, the respective elements provided on the black ceramic layer are prevented by the black ceramic layer from being seen from the vehicle exterior side of the window glass 2. Thus, the window glass 2 excels in design.

As shown in FIG. 3, the antenna conductor 6 is a linear conductor integrated with the feeding electrode 7. In FIG. 3, as for the antenna conductor 6, only a part of the neighborhood of the feeding electrode 7 is shown. The antenna conductor 6 includes a signal-side antenna conductor 6A (left side in FIG. 3) and an earth-side antenna conductor 6B (right side in FIG. 3). The feeding electrode 7 includes a signal-side feeding electrode 7A (left side in FIG. 3) and an earth-side feeding electrode 7B (right side in FIG. 3). In an end portion of the signal-side antenna conductor 6A, the signal-side feeding electrode 7A that is larger in width than the signal-side antenna conductor 6A is provided. In an end portion of the earth-side antenna conductor 6B, the earth-side feeding electrode 7B that is larger in width than the earth-side antenna conductor 6B is provided. The signal-side feeding electrode 7A and the earth-side feeding electrode 7B are provided at positions far from each other by a predetermined distance. A pattern of the antenna conductor 6 is not limited to the pattern shown in FIG. 3. For example, the pattern may be either a pattern in which plural conductors are provided in at least one of the electrodes, or a pattern in which one or plural conductors are provided in one of the electrodes, but no conductor is provided in the other electrode.

As shown in FIG. 2, the connector 4 includes a connector main body 9 and a terminal electrode 10. The connector main body 9 supports the coaxial cable K for feeding. The terminal electrode 10 includes a signal-side terminal electrode 10A corresponding to the signal-side feeding electrode 7A of the antenna 3 and an earth-side terminal electrode 10B corresponding to the earth-side feeding electrode 7B of the antenna 3. The signal-side terminal electrode 10A is electrically connected to a core wire of the coaxial cable K. The earth-side terminal electrode 10B is electrically connected to an outer conductor of the coaxial cable K.

As shown in FIG. 2, the signal-side terminal electrode 10A and the earth-side terminal electrode 10B are provided in both end portions in the longitudinal direction of the connector main body 9, respectively. A joint surface 10*a* of the terminal electrode 10 with the feeding electrode 7 and a first surface 9*a* of the connector main body 9 as an opposing surface to the window glass 2 are positioned on the substantially same plane. The terms "positioned on the substantially same plane" as referred to herein mean a concept including the matter that a difference in level is present between the joint surface 10*a* with the feeding electrode 7 and the first surface 9*a* of the connector main body 9, and the difference in level is 1 mm or less.

Figure 5:
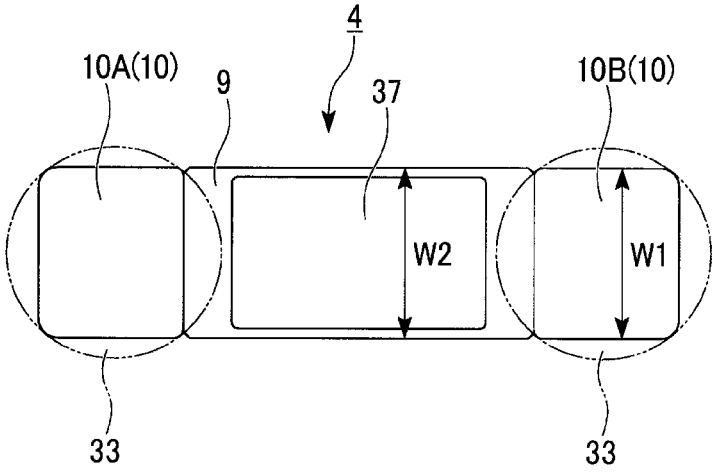
FIG. 5 is a rear view of a connector.

As shown in FIG. 5, when viewed from the normal direction of the first surface 2*a* of the window glass 2, a planar shape of the connector main body 9 is a rectangle, and a planar shape of the terminal electrode 10 is a rectangular, too. A width W1 of the terminal electrode 10 when viewed from the normal direction of the first surface 2*a* of the window glass 2 is substantially equal to a width W2 of the connector main body 9 when viewed from the normal direction of the first surface 2*a* of the window glass 2. The terms "substantially equal" as referred to herein mean a concept including the matter that a difference between the width W1 of the terminal electrode 10 and the width W2 of the connector main body 9 is 1 mm or less, a value of which is corresponding to a manufacturing tolerance.

The term "width" as referred to herein means dimensions of the direction orthogonal to the longitudinal direction of the connector main body 9 and parallel to the first surface 2*a* of the window glass 2.

As shown in FIG. 2, the connector main body 9 includes a holder portion 12 and a pickup portion 13.

The holder portion 12 includes an insulating case 15, a connection portion 16 (see FIG. 3), and a connecting pin 17 (see FIG. 3). The insulating case 15 is a case in which an opening into which the pickup portion 13 is to be fitted is made of an upwardly opened insulating material such as a resin. The connection portion 16 is electrically connected to a connection portion 22A of the pickup portion 13 as described later. The connecting pin 17 extends vertically upward from an inner bottom of the holder portion 12 and is electrically connected to the signal-side terminal electrode 10A.

The signal-side terminal electrode 10A and the earth-side terminal electrode 10B are fixed to the holder portion 12. As for a specific configuration, the signal-side terminal electrode 10A is provided in one of the end portions in the longitudinal direction of the insulating case 15. The earth-side terminal electrode 10B is provided in the end portion on the opposite side to the side on which the signal-side terminal electrode 10A in the longitudinal direction of the insulating case 15 is provided. The signal-side terminal electrode 10A is fixed to the insulating case 15 by a fixing portion 18 erected so as to sandwich the both side surfaces of the insulating case 15. Similarly, the earth-side terminal electrode 10B is fixed to the insulating case 15 by a fixing portion 19 erected so as to sandwich the both side surfaces of the insulating case 15.

The pickup portion 13 is detachably fitted to the holder portion 12.

Figure 6:
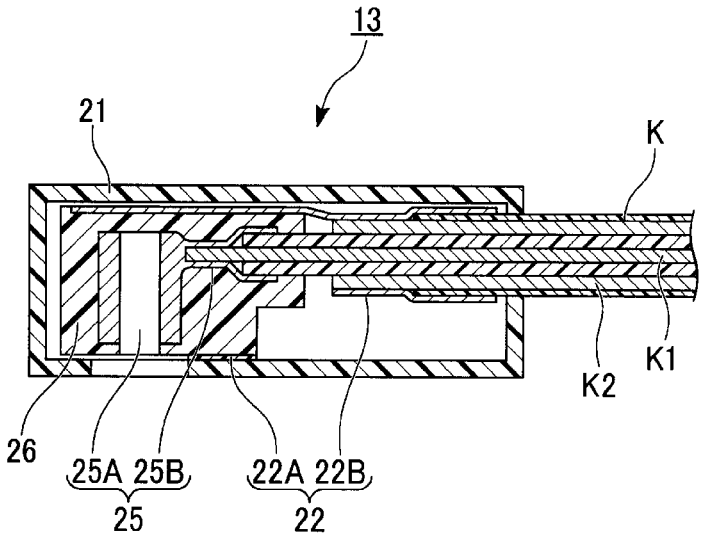
FIG. 6 is a cross-sectional view of a pickup portion.

As shown in a cross-sectional view of FIG. 6, the pickup portion 13 includes an insulating case 21, an earth conductor 22, a fitting terminal 25, and a fitting terminal fixing insulating case 26. The insulating case 21 is a case having a substantially rectangular parallelepiped shape and made of an insulating material such as a hollow resin. The earth conductor 22 includes a connection portion 22A and a fixing portion 22B. The connection portion 22A is positioned in the inside of the insulating case 21 and connected to the connection portion 16 of the holder portion 12 in a state in which the pickup portion 13 is fitted into the holder portion 12 (see FIG. 3). When an outer conductor K2 of the coaxial cable K having been introduced into the inside of the insulating case 21 is crimped from the outside, the fixing portion 22B is electrically conducted to the outer conductor K2.

The fitting terminal 25 is fixed to the inside of the fitting terminal fixing insulating case 26. The fitting terminal fixing insulating case 26 is fixed to the inside of the earth conductor 22. The fitting terminal 25 has a fitting portion 25A and a core wire fixing portion 25B. The fitting portion 25A is fitted into the connecting pin 17 of the holder portion 12 (see FIG. 3). When a core wire K1 of the coaxial cable K is crimped from the outside, the core wire fixing portion 25B is electrically conducted to the core wire K1. The earth conductor 22 including the fixing terminal 25 and the fitting terminal fixing insulating case 26 is fixed to the inside of the insulating case 21. When the fitting terminal 25 is fitted into the core wire K1 of the coaxial cable K and the connecting pin 17 of the holder portion 12, the fitting terminal 25 transmits signals from the connecting pin 17 into the core wire K1.

In the present embodiment, an example in which the connector main body 9 is constituted of two members of the holder portion 12 and the pickup portion 13 that are mutually detachable is shown. However, the configuration of the connector main body is not limited thereto. The connector main body may be constituted of a single member or may be constituted of three or more members.

A detailed configuration of a joint portion between the feeding electrode 7 and the terminal electrode 10 is hereunder described with reference to FIGS. 2 and 4. The joint portion between the feeding electrode 7 and the terminal electrode 10 is hereinafter referred to as "terminal portion 32".

As shown in FIG. 2, the terminal portion 32 is provided in the both ends in the longitudinal direction of the connector 4. The terminal portion 32 includes a signal-side terminal portion 32A and an earth-side terminal portion 32B. The signal-side terminal portion 32A has a constitution in which the signal-side feeding electrode 7A and the signal-side terminal electrode 10A are joined via an insulating adhesive 33 and capacitively coupled with each other. The earth-side terminal portion 32B has a constitution in which the earth-side feeding electrode 7B and the earth-side terminal electrode 10B are joined via an insulating adhesive 33 and capacitively coupled with each other. In this way, the signal-side terminal portion 32A and the earth-side terminal portion 32B have the same constitution.

Figure 4:
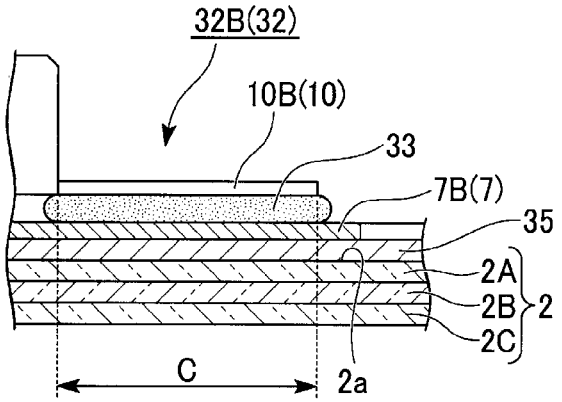
FIG. 4 is a cross-sectional view of a terminal portion.

In FIG. 4, the earth-side terminal portion 32B surrounded by a circle A shown by a two-dotted line in FIG. 2 is enlargedly shown. Accordingly, the earth-side terminal portion 32B is hereunder described as an example.

As shown in FIG. 4, the window glass 2 of the present embodiment is constituted of a laminated glass in which a first glass layer 2A, a resin layer 2B, and a second glass layer 2C are successively laminated. In the first surface 2*a* of the window glass 2, a black ceramic layer 35 is provided in the connector 4 and a region in the neighborhood thereof. The earth-side feeding electrode 7B is provided on the black ceramic layer 35. The earth-side terminal electrode 10B is provided in an upper portion of the earth-side feeding electrode 7B while putting a predetermined gap from the earth-side feeding electrode 7B. The insulating adhesive 33 is provided in a space between the earth-side feeding electrode 7B and the earth-side terminal electrode 10B. The earth-side feeding electrode 7B is larger than the earth-side terminal electrode 10B and is protruded outside the earth-side terminal electrode 10B. For that reason, when viewed from the normal direction of the first surface 2*a* of the window glass 2, a portion C where the earth-side feeding electrode 7B and the earth-side terminal electrode 10B overlap with each other functions mainly as a capacitively-coupled capacitor. In the case where in other place than the symbol C in FIG. 4, a portion where the feeding electrode and the terminal electrode are opposed to each other without an insulating adhesive is present, such a portion also contributes to the capacitive coupling.

As the insulating adhesive 33, an insulating paste-like adhesive of a type such that it is cured without applying heat is preferably used. Examples of the insulating adhesive of this type include a single component, moisture-curable type urethane adhesive (a product number: WS-292A, manufactured by Yokohama Rubber Co., Ltd.) and a two-liquid mixing type epoxy•modified silicone adhesive (a product number: MOS200, manufactured by Konishi Co., Ltd.). The moisture-curable type adhesive is an adhesive which reacts with moisture in the atmosphere, whereby curing is advanced. The two-liquid mixing type adhesive is an adhesive which forcedly generates a chemical reaction by the addition of a curing agent and is cured.

The above-described single component, moisture-curable type urethane adhesive contains, a urethane prepolymer having a terminal isocyanate group, carbon black, a filler, and a plasticizer as a preliminary composition, a polyisocyanate compound having three or more NCO groups as a tackifier, either one or both of a reaction product between a tin-based catalyst and a silicic acid ester compound and dibutyltin bis as a first catalyst, and dimorpholinodiethyl ether (DMDEE) as a second catalyst.

The above-described two-liquid mixing type epoxy•modified silicone adhesive is constituted of a main liquid containing an epoxy resin and a modified silicone polymer curing agent and an auxiliary liquid containing a modified silicone polymer, an epoxy curing agent, and a carbon black coloring agent.

As the insulating adhesive 33, a thermosetting adhesive may be used. For example, a thermosetting acrylic epoxy-based adhesive (a product number: 9270, manufactured by 3M Japan Limited), a thermosetting urethane-based adhesive, and the like may be used.

As shown in FIG. 2, a pressure-sensitive adhesive double-coated tape 37 is provided between the holder portion 12 of the connector 4 and the window glass 2. The connector 4 and the window glass 2 are fixed to each other by the pressure-sensitive adhesive double-coated tape 37. The pressure-sensitive adhesive double-coated tape 37 plays a role as a spacer of keeping a gap between the holder portion 12 of the connector 4 and the window glass 2 at a fixed level. The insulating adhesive 33 is an adhesive of a type which is spontaneously cured upon being allowed to stand at normal temperature, and therefore, it is required to take a long time to some degree until it is cured. Accordingly, the pressure-sensitive adhesive double-coated tape 37 also plays a role of temporarily fixing the holder portion 12 of the connector 4 to the window glass 2 such that the position of the connector 4 is not deviated until the insulating adhesive 33 is cured.

The terminal electrode of the connector in the conventional antenna apparatus was joined with the feeding electrode by means of soldering. On the other hand, in the antenna apparatus 1 of the present embodiment, the terminal electrode 10 and the feeding electrode 7 are joined with each other with the insulating adhesive 33 and also capacitively coupled with each other via the insulating adhesive 33. Here, as parameters that influence transmission properties of the terminal portion 32, an electrostatic capacity and an impedance are considered. When a dielectric constant of the insulating adhesive 33 is defined as $\varepsilon_r$ [−], a dielectric constant of vacuum is defined as $\varepsilon_0$ [F/m], a dielectric tangent of the insulating adhesive 33 is defined as tan δ [−], an adhesive area of the insulating adhesive 33 (an area of the capacitor C) is defined as S [$m^2$], and a thickness of the insulating adhesive 33 is defined as d [m], an electrostatic capacity C [F] of the terminal portion 32 is expressed by the following formula (1).

$$C = \varepsilon_r \varepsilon_0 (1 - j \tan\delta) \frac{S}{d} \tag{1}$$

When a frequency of the transmitted high-frequency signal is defined as f [Hz], an impedance Z [Ω] of the terminal portion 32 is expressed by the following formula (2).

$$|Z| = \left| \frac{1}{j2\pi f C} \right| = \frac{1}{2\pi f \varepsilon_r \varepsilon_0 \sqrt{1 + \tan^2\delta}} \frac{d}{S} \tag{2}$$

From the formulae (1) and (2), assuming that the frequency f of high-frequency signal, the adhesive area S of the insulating adhesive 33, and the thickness d of the insulating adhesive 33 are constant, the electrostatic capacity C and the impedance Z are determined by the dielectric constant $\varepsilon_r$ of the insulating adhesive 33. In order to increase the transmission properties of the terminal portion 32, it is preferred that the electrostatic capacity C is larger, and it is preferred that the impedance Z is smaller. In order to make the electrostatic capacity C large and the impedance Z small, it is preferred that the dielectric constant $\varepsilon_r$ of the insulating adhesive 33 is large.

In addition, the insulating adhesive 33 is required to have not only transmission properties of the terminal portion 32 but also an adhesive performance sufficient for ensuring the mechanical strength of the terminal portion 32. Taking into consideration the matter that an area of the adhesive portion of the terminal electrode of the connector that is used in the present embodiment is 8 mm×9.7 mm=77.6 $mm^2$, so long as a shear adhesive strength of the adhesive is 1.0 MPa or more, the shear strength of the adhesive portion becomes 77.6 $mm^2 \times 1.0$ MPa=77.6 N, whereby a practically sufficient shear strength is obtained. Therefore, the insulating adhesive that is used in the present embodiment is preferably an adhesive having such properties that the shear adhesive strength is 1.0 MPa or more. For example, so long as the adhesive strength is larger than 68.6 N that is an upper limit value of an insertion/removal force of connector described in D5403 of JASO (Japanese Automotive Standards Organization), the holder portion of the connector does not fall down from the glass surface, and hence, it may be said that such strength is a practically sufficient strength.

Then, the present inventors prepared test pieces for evaluation of transmission properties/mechanical strength as described below and measured the transmission properties and strength with respect to Example 1, Example 2, Comparative Example, and Conventional Example as described below. The test piece for evaluation of transmission properties/mechanical strength is hereinafter abbreviated as a test piece.

An evaluation method of an insulating adhesive and evaluation results are hereunder described.

A trial production condition that is common in the test pieces of Example 1, Example 2, Comparative Example, and Conventional Example is as follows.

The test piece is one in which a coplanar waveguide of 50Ω was printed with a silver paste on a regular square-shaped glass substrate having each side of 100 mm and a thickness of 5 mm, and after baking, a connector was mounted thereon by the method proposed in the present embodiment. The connector includes a terminal electrode having an external form of a rectangle of 8 mm×9.7 mm. An adhesive area of the insulating adhesive equal to an area of the terminal electrode was 8 mm×9.7 mm=77.6 $mm^2$. As a pressure-sensitive adhesive double-coated tape, one having a thickness of 0.4 mm was used. Accordingly, a thickness of the insulating adhesive equal to the thickness of the pressure-sensitive adhesive double-coated tape was 0.4 mm.

As for Examples 1 and 2, test pieces of the above-described present embodiment were prepared.

Specifically, as for Example 1, a test piece in which a terminal electrode and a coplanar waveguide were joined with each other with a single component, moisture-curable type urethane adhesive (a product number: WS-292A, manufactured by Yokohama Rubber Co., Ltd., volume resistivity: $10^4$ Ω·m) was prepared.

As for Example 2, a test piece in which a terminal electrode and a coplanar waveguide were joined with each other with a two-liquid mixing type epoxy•modified silicone adhesive (a product number: MOS200, manufactured by Konishi Co., Ltd., volume resistivity: $10^{12}$ Ω·m) was prepared.

A basic performance of each of the insulating adhesives used in Examples 1 and 2 is shown in Table 1.

TABLE 1

| | Classification | Basic performance |
|---|---|---|
| Example 1 | Moisture-curable type urethane adhesive | Electric performance: Dielectric constant $\varepsilon_r$ = 11.8, tan δ = 0.12 Adhesive performance: Shear adhesive strength = 6.0 MPa |
| Example 2 | Epoxy•modified silicone adhesive | Electric performance: Dielectric constant $\varepsilon_r$ = 4.0, tan δ = 0.08 Adhesive performance: Shear adhesive strength = 4.6 MPa |

As for Comparative Example, a test piece in which a terminal electrode and a coplanar waveguide were joined with each other with a pressure-sensitive adhesive double-coated tape was prepared. As the pressure-sensitive adhesive double-coated tape, an acrylic foam tape (a product number: GT7104, manufactured by 3M Japan Limited) was used.

As for Conventional Example, a test piece in which a terminal electrode and a coplanar waveguide were joined with each other by means of soldering was prepared. With respect to the test piece of the Conventional Example, only the electric characteristic was evaluated.

The evaluation item is two items of insertion loss as the electric characteristic and shear strength of connector as the mechanical characteristic. As for the insertion loss, a coaxial cable of 50Ω was connected to each of the connector and the coplanar waveguide, and a frequency characteristic of the insertion loss was measured with a network analyzer. As for the shear strength, a shear load was applied to a joint portion of the connector using a shear tester, and the shear load when the connector was fractured was measured as the shear strength.

Figure 7:
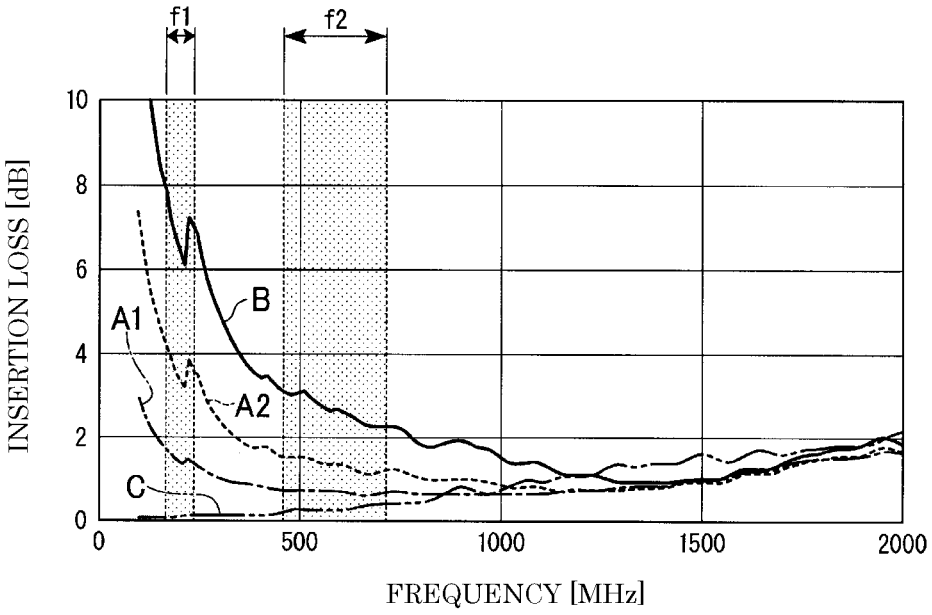
FIG. 7 is a graph showing frequency dependence of an insertion loss of an antenna apparatus.

FIG. 7 is a graph showing a frequency characteristic of insertion loss.

The abscissa of FIG. 7 is a frequency [MHz], and the ordinate of FIG. 7 is an insertion loss [dB].

A graph of a symbol A1 shows the data of Example 1; a graph of a symbol A2 shows the data of Example 2; a graph of a symbol B shows the data of Comparative Example; and a graph of a symbol C shows the data of Conventional Example.

In the digital radio (DAB) mainly in Europe, a frequency band of radio wave signals for digital radio broadcasting is 174 MHz to 240 MHz. The DAB frequency band is shown by a symbol f1 in FIG. 7. In the digital terrestrial television (DTV) broadcasting in Japan, a frequency band of radio wave signals for digital terrestrial television broadcasting is 470 MHz to 710 MHz. The DTV frequency band is shown by a symbol f2 in FIG. 7.

As shown in FIG. 7, in each of the DAB frequency band (f1) and the DTV frequency band (f2), though the test pieces of Example 1 (symbol A1) and Example 2 (symbol A2) were inferior in the insertion loss to Conventional Example (symbol C) having a conductive joint by means of soldering, the insertion loss could be suppressed small as compared with Comparative Example (symbol B) using a pressure-sensitive adhesive double-coated tape. In practical use, if the insertion loss is about 2 dB or less, the preparation of an antenna apparatus becomes easy, and so long as the DAB frequency band f1 is concerned, it is preferred to use the urethane adhesive used in Example 1. So long as the DTV frequency band is concerned, all of the urethane adhesive used in Example 1 and the epoxy•modified silicone adhesive used in Example 2 are suitable. However, even in the case where the insertion loss is more than 2 dB, it is possible to prepare a practically sufficient antenna apparatus by adjusting the characteristics of the antenna. Accordingly, the connector mounting method that the present invention proposes is not limited to the mounting method in which the insertion loss is 2 dB or less.

The above-described evaluation results are premised on an assumption that the adhesive area is 77.6 $mm^2$, and the thickness of the insulating adhesive is 0.4 mm. Accordingly, so long as the adhesive area may be enlarged, there is a possibility that an insulating adhesive having a smaller dielectric constant may be used.

The measurement results of the shear strength are shown in Table 2. It is a practical target to obtain a shear strength of 80 N or more.

TABLE 2

| | Adhesive | Shear strength [N] |
|---|---|---|
| Example 1 | Moisture-curable type urethane adhesive | 288 |
| Example 2 | Epoxy•modified silicone adhesive | 294 |
| Comparative Example | Acrylic double-coated tape | 176 |

As shown in Table 2, with respect to all of the test pieces, 80 N or more, a value of which is the target value of the shear strength, could be satisfied. Furthermore, in the test pieces of Examples 1 and 2, a high shear strength could be obtained as compared with Comparative Example using a pressure-sensitive adhesive double-coated tape.

Next, the present inventors made antenna apparatuses of Examples 1 and 2 and Conventional Example as describe below on an experimental basis and evaluated a reception performance thereof.

A trial production method that is common in Example 1, Example 2, and Conventional Example is hereunder described.

The antenna apparatus of the present embodiment is an antenna apparatus applied to a windshield of an automobile and is one suitably designed for receiving radio waves of digital radio (DAB) in Europe.

Figure 8:
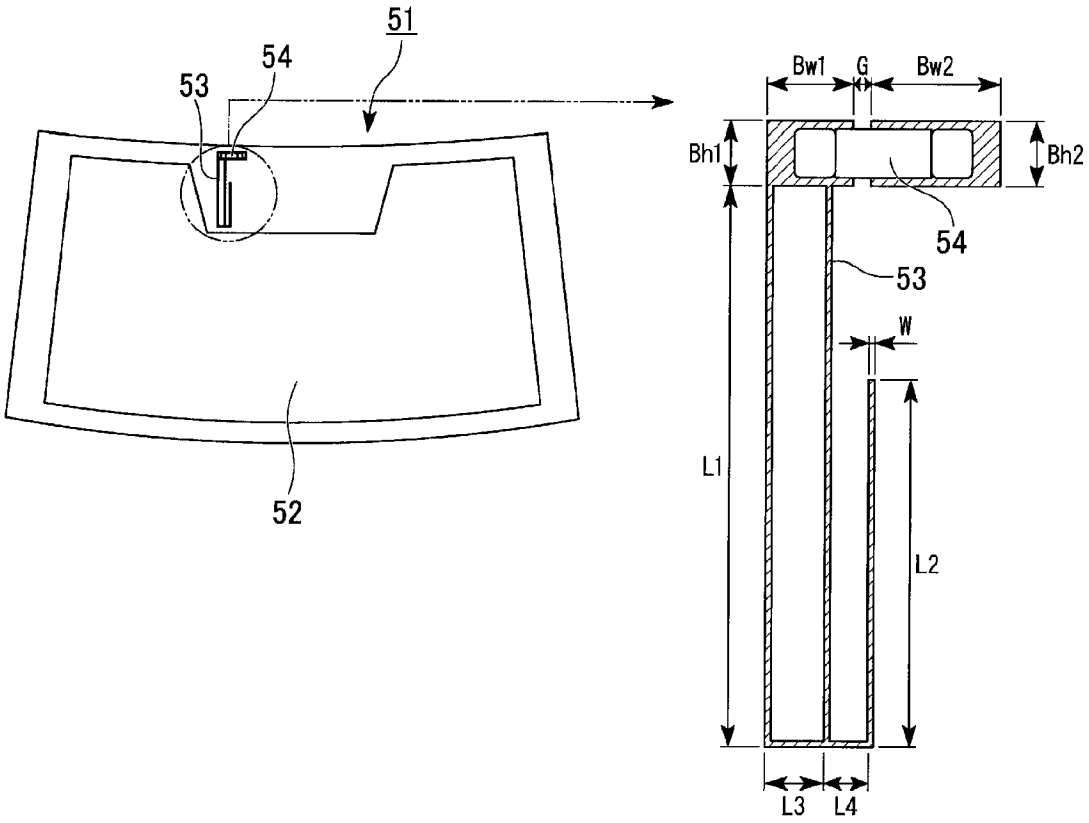
FIG. 8 is a configuration view of a vehicular antenna apparatus of a first embodiment.

FIG. 8 shows a configuration of the antenna apparatus of the present embodiment.

An antenna apparatus 51 includes a front window glass 52 of an automobile, an antenna 53, and a connector 54.

Dimensions of each of portions of the antenna 53 shown in FIG. 8 are shown in Table 3.

Ltd.). In Conventional Example, the terminal electrode and the feeding electrode were bonded to each other by means of soldering.

Results obtained by installing each of the antenna apparatuses as prepared by the above-described method in an actual automobile and measuring a reception gain thereof are hereunder described.

The measurement of the reception gain was performed by placing an automobile including the antenna apparatus on a turn table and rotating the automobile by 360°. In addition, the measurement was performed at a frequency in the range of from 174 MHz to 240 MHz at every 3 MHz. The data of the reception gain are a value obtained by averaging values measured by rotating the automobile by 360° at a rotation angle of every 1° at every frequency. An elevation angle between the emitting position of a radio wave and the antenna conductor was measured in a substantially horizontal direction (a direction at an elevation angle of 0° in the case of defining an elevation angle of a surface parallel to the ground as 0° and an elevation angle in the zenith direction as 90°, respectively). The reception gain was measured on a basis of a reception gain of a half-wave dipole antenna.

Figure 9A:
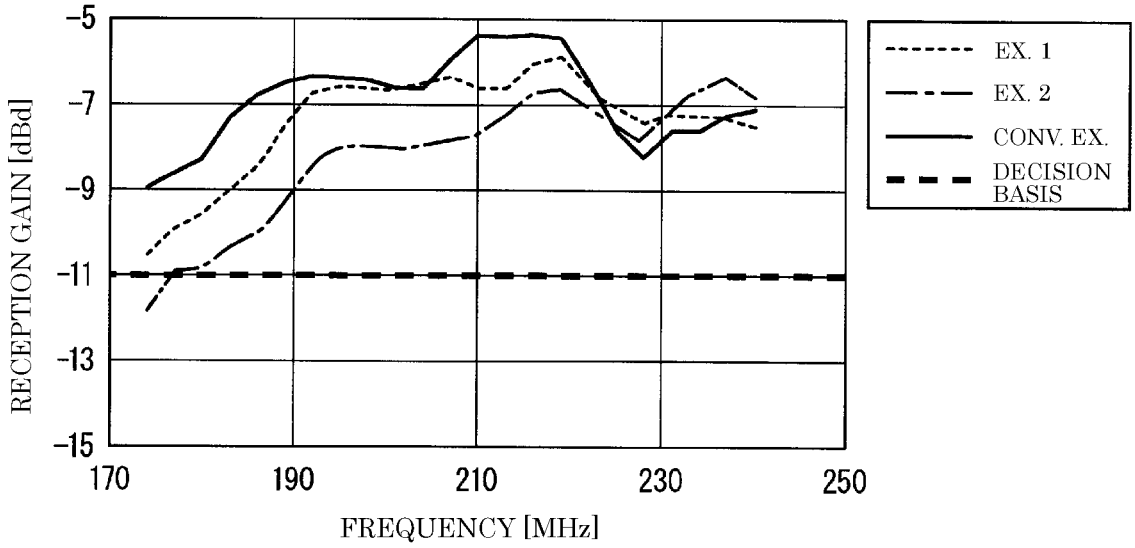
FIGS. 9A and 9B each show measurement results of a reception gain of a vehicular antenna apparatus of a first embodiment.

Measurement results are shown in a graph in FIG. 9A. As compared with the reception gain of Conventional Example, in Example 1, though a slight decrease of the reception gain is seen due to the insertion loss generated by the terminal portion, it was confirmed that the antenna apparatus of Example 1 has a practically sufficient reception performance.

On the other hand, in Example 2, the electrostatic capacity of the terminal portion is smaller than that in Example 1, namely the insertion loss is larger. For that reason, as compared with the results of Example 1, the results were revealed such that the reception gain is reduced more largely.

Figure 9B:
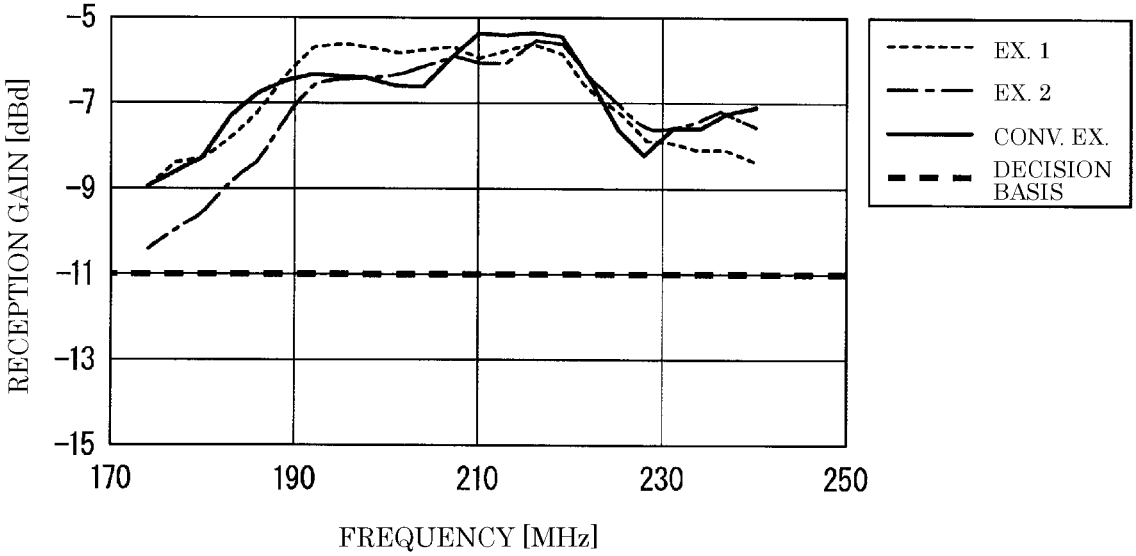

Next, as for Examples 1 and 2, the reception gain in a state in which the antenna shape was adjusted was measured. Measurement results of the reception gain are shown in FIG. 9B.

TABLE 3

| | | Minimum value in band | Dimensions of antenna [mm] | | | | | | | | | |
|---|---|---|---|---|---|---|---|---|---|---|---|---|
| | | [dBd] | L1 | L2 | L3 | L4 | W | Bh1 | Bw1 | Bh2 | Bw2 | G |
| Conventional Example | | −8.9 | 130 | 85 | 14 | 9 | 1 | 15 | 20 | 15 | 30 | 4 |
| Example 1 | Non-adjusted | −10.5 | 130 | 85 | | | | | | | | |
| | After adjustment | −9.0 | 135 | 115 | | | | | | | | |
| Example 2 | Non-adjusted | −11.8 | 130 | 85 | | | | | | | | |
| | After adjustment | −10.4 | 150 | 115 | | | | | | | | |

The connector 54 includes a terminal electrode in which an external form of an adhesive portion thereof is a rectangular shape of 8 mm×9.7 mm.

As for the pressure-sensitive adhesive double-coated tape, a pressure-sensitive adhesive double-coated tape having a thickness of 0.4 mm was used.

In Example 1, the terminal electrode and the feeding electrode were bonded to each other with a single component, moisture-curable type urethane adhesive (a product number: WS-292A, manufactured by Yokohama Rubber Co., Ltd.). In Example 2, the terminal electrode and the feeding electrode were bonded to each other with a two-liquid mixing type epoxy•modified silicone adhesive (a product number: MOS200, manufactured by Konishi Co., The adjustment was performed by extending the lengths L1 and L2 of the antenna conductor.

Dimensions of each of portions of the antenna 53 after the shape adjustment are shown in Table 3.

As a result, in both of Example 1 and Example 2, it was confirmed that the reception gain is improved to an extent equal to that in Conventional Example, namely both Example 1 and Example 2 have a practically sufficient reception performance.

This is caused due to the results in which by extending the antenna conductor, the characteristic impedance possessed by the antenna is shifted to inductive properties to negate influences of the capacitive impedance of the terminal portion, thereby reducing the insertion loss.

As noted from the foregoing results, even in the case of replacing the conventional connector mounting method of an antenna apparatus having a connector mounted therein by means of soldering by a mounting structure with an insulating adhesive, by subjecting the antenna shape to fine adjustment such that an electrical effective length of the antenna becomes long, an antenna apparatus having a practical sufficient reception performance, in which the insertion loss generated in the adhesive portion, namely the terminal portion is reduced, could be prepared.

The present inventors have found that a reason why while the dielectric constant of a general urethane resin is about 6 to 7, the dielectric constant of the single component, moisture-curable type urethane adhesive (a product number: WS-292A, manufactured by Yokohama Rubber Co., Ltd.) as used for the insulating adhesive in Example 1 is high as 11.8 resides in the presence of carbon black. The present inventors had supposed that, as compared with an acrylic foam tape (pressure-sensitive adhesive double-coated tape) having a dielectric constant of about 2, by using a urethane-based adhesive, a dielectric constant of about 6 to 7 is obtainable; however, they did not suppose that a high dielectric constant of up to 11.8 is obtainable. As a result of investigations made by the present inventors, it has become clear that the carbon black that is contained in the insulating adhesive for the purpose of coloration increases the dielectric constant, whereby a dielectric constant higher than that as supposed is obtained. Accordingly, it is preferred that the insulating adhesive that is used in the present embodiment contains carbon black.

The antenna apparatus 1 of the present embodiment includes the terminal portion 32 in which the feeding electrode 7 and the terminal electrode 10 are capacitively coupled with each other with the insulating adhesive 33 in place of the conventional structure in which the feeding electrode of the antenna and the terminal electrode of the connector are subjected to conductive joining with each other with a solder. According to this, it is not necessary to use a solder at the time of mounting the connector, and a heating step is unnecessary, and therefore, a damage generated on the window glass 2 can be reduced. In particular, a laminated glass that is used for a windshield of an automobile is lower in heat resistance than a strengthened glass that is used for a rear glass or the like. For that reason, the antenna 1 of the present embodiment is more effective as an antenna apparatus to be applied to a windshield of an automobile. In addition, by selecting the insulating adhesive 33 having high dielectric constant and shear adhesive strength as in the above-exemplified urethane adhesive or epoxy•modified silicone adhesive, an antenna apparatus having a joint portion of the connector 4 provided with both good mechanical strength and electric characteristic can be realized.

As described previously, in order to ensure transmission properties of the terminal portion 32, an increase of the electrostatic capacity and a decrease of the impedance of the terminal portion 32 are necessary. Besides the use of an insulating adhesive with a high dielectric constant, it is also possible to achieve an increase of the electrostatic capacity and a decrease of the impedance by, for example, making the adhesive area large. However, when the adhesive area is made excessively large by, for example, making the width W1 of the terminal electrode 10 larger than the width W2 of the connector main body 9, there is caused another problem, such as the matter that the area occupied by the connector 4 becomes large, thereby lowering visibility of the window glass 2. In contrast to this, in the case of the present embodiment, since the width W1 of the terminal electrode 10 is made substantially equal to the width W2 of the connector main body 9, the maximum adhesive area can be ensured within the range where the area occupied by the connector 4 does not become large so much, and good transmission properties can be obtained.

Alternatively, it is also possible to achieve an increase of the electrostatic capacity and a decrease of the impedance of the terminal portion 32 by making the thickness of the insulating adhesive 33 small. However, if the thickness of the insulating adhesive 33 is made excessively small, there are caused other problems, such as the matter that the adhesive strength of the connector 4 against the window glass 2 is decreased; and the matter that a place where the insulating adhesive 33 does not exist is formed, whereby stable transmission properties are hardly obtained. In contrast to this, in the case of the present embodiment, since the pressure-sensitive adhesive double-coated tape 37 functioning as a spacer is used, the thickness of the insulating adhesive 33 is stable, whereby not only stable adhesive strength is obtained, but also stable transmission properties are obtained. Furthermore, the pressure-sensitive adhesive double-coated tape 37 also plays a role as a temporarily fixing member until the insulating adhesive 33 is cured, and therefore, it may be contemplated to decrease the number of parts.

As described above, the joint surface 10*a* of the terminal electrode 10 with the feeding electrode 7 and the first surface 9*a* of the connector main body 9 as an opposing surface to the window glass 2 are positioned on the substantially same plane. That is, the terminal electrode 10 has a shape flatly extending in the direction along the first surface 9*a* of the connector main body 9. For that reason, when the pressure-sensitive adhesive double-coated tape 37 is stuck onto the first surface 9*a* of the connector main body 9, and the connector 4 is then mounted on the window glass 2 via the insulating adhesive 37, the thickness of the insulating adhesive 37 coincides with the thickness of the pressure-sensitive adhesive double-coated tape 37 in due course. Accordingly, the thickness of the insulating adhesive 33 can be determined by the thickness of the used pressure-sensitive adhesive double-coated tape 37, so that the electrostatic capacity and impedance of the terminal portion 32 are readily controlled.

Assuming that the feeding electrode 7 and the terminal electrode 10 are joined with each other with a pressure-sensitive adhesive double-coated tape, it is difficult to allow the connector 4 to follow a curve of the window glass 2. In particular, in the case where a curvature of the window glass 2 is large, there is a concern that inconvenience occurs, for example, it is difficult to fix the connector 4, or when the connector 4 is pressed onto the window glass 2 by force, a stress on the connector 4 is generated. In addition, in view of the fact that an elastic member or the like becomes necessary for the purpose of allowing the connector 4 to follow a curve of the window glass 2, the fact that the electrode thickness is needed to be made thin such that the terminal electrode 10 is readily deformed, or other fact, the design and configuration of the connector 4 become complicated. In contrast to this, in the antenna apparatus 1 of the present embodiment, the feeding electrode 7 and the terminal electrode 10 are fixed with the insulating adhesive 33 that exhibits a paste-like state at the point of time before curing. According to this, the curve of the widow glass 2 can be absorbed by the thickness of the insulating adhesive 33, and it is not necessary to make the connector 4 to follow the curve of the window glass 2. Therefore, the design and configuration of the connector 4 can be simplified. In addition, it is not necessary to make the terminal electrode 10 thin, and the strength of the terminal electrode 10 can be ensured.

Second Embodiment

A second embodiment of the present invention is hereunder described with reference to FIGS. 10 and 11.

A basic configuration of the antenna apparatus of the second embodiment is the same as in the first embodiment, and the shape of the terminal electrode of the connector is different from that in the first embodiment.

Figure 10:
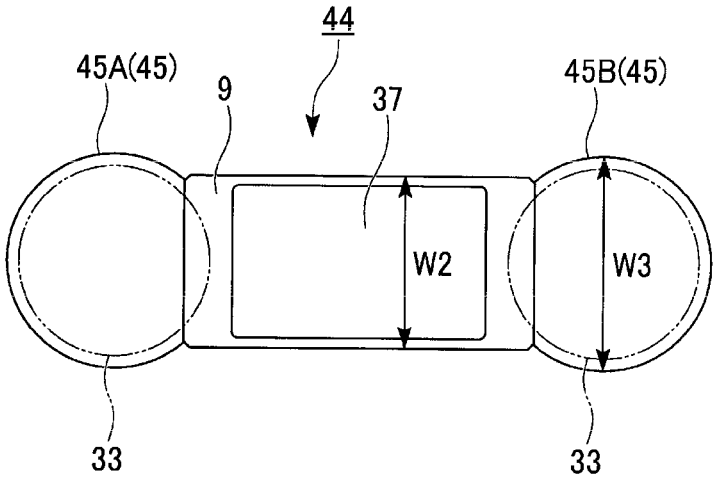
FIG. 10 is a rear view of a connector in an antenna apparatus of a second embodiment.

In FIGS. 10 and 11, constituent elements common to those in the drawings used in the first embodiment are given the same symbols, and detailed descriptions thereof are omitted.

In the connector of the first embodiment, a planar shape of the terminal electrode is a rectangle. In contrast to this, as shown in FIG. 10, in a connector 44 of the second embodiment, a planar shape of a terminal electrode 45 is a shape in which a part of a circle is cut off by a straight line (chord) that does not go through a center of the circle. That is, an external shape of the terminal electrode 45 includes a part of the circle. The terminal electrode 45 is disposed in the direction in which a linear edge thereof comes into contact with an edge of a connector main body 9. A signal-side terminal electrode 45A and an earth-side terminal electrode 45B have the same shape and same dimensions and are disposed in a line symmetry relative to a center line dividing the longitudinal direction of the connector main body 9 into two equal parts. The external shape of the terminal electrode is not always limited to one including a part of the circle. For example, the external shape of the terminal electrode may include at least a part of an ellipse, may include at least a part of an oval shape, or may include a curved portion other than those described above.

A diameter of the circle constituting a part of the external form of the terminal electrode 45 is defined as a width W3 of the terminal electrode 45 when viewed from the normal direction of the first surface of the window glass. At this time, when viewed from the normal direction of the first surface of the window glass, the width W3 of the terminal electrode 45 is larger than a width W2 of the connector main body 9. That is, the terminal electrode 45 is designed so as to be protruded outside the width direction as compared with the connector main body 9. In addition, the terminal electrode 45 of the second embodiment is designed such that an area of the terminal electrode 45 is substantially equal to an area of the terminal electrode 10 of the first embodiment.

Figure 11A:
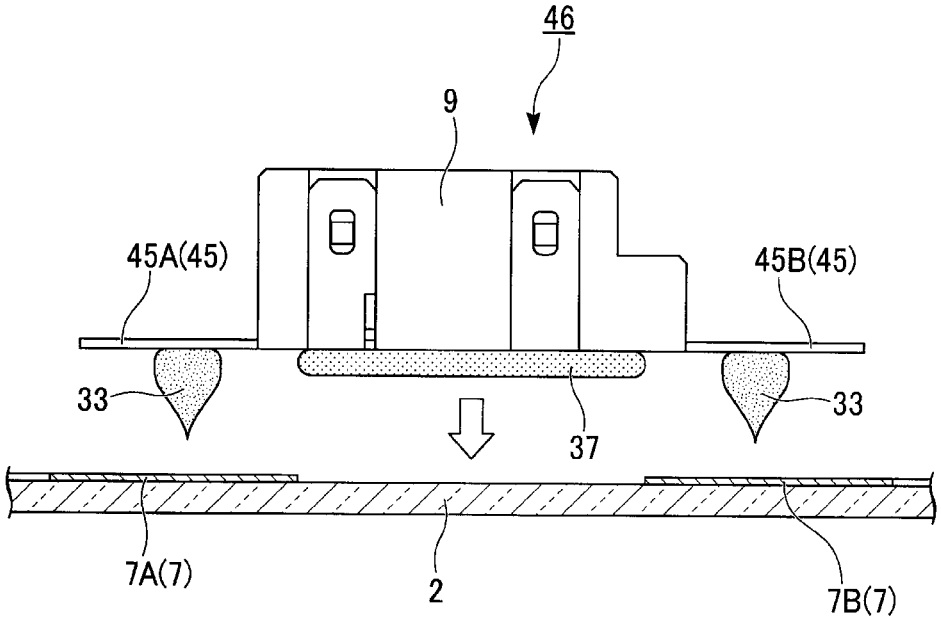
FIG. 11A is a side view showing a state before mounting a connector.
Figure 11B:
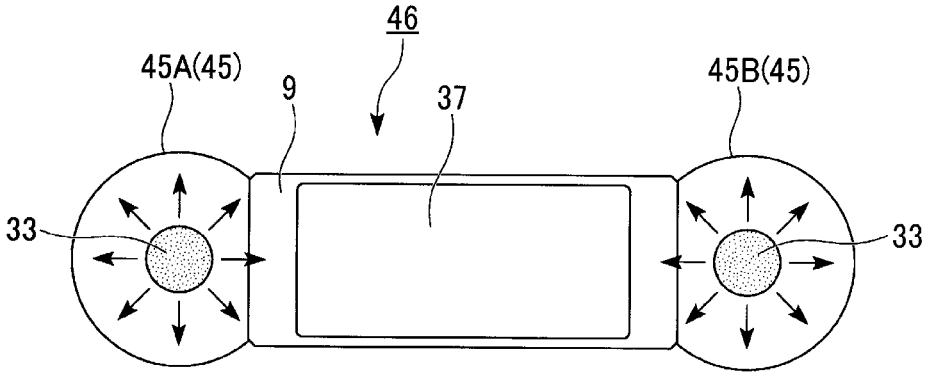
FIG. 11B is a rear view showing a state before mounting a connector.

In mounting a holder portion 46 of the connector 44 on a feeding electrode 7 of a window glass 2, for example, as shown in FIGS. 11A and 11B, a pressure-sensitive adhesive double-coated tape 37 is stuck onto a lower surface of the connector main body 9, an insulating adhesive 33 is applied in the vicinity of the center of the terminal electrode 45, and the holder portion 46 is then pressed onto the window glass 2. According to this, the insulating adhesive 33 having risen in the center of the terminal electrode 45 spreads toward the periphery of the terminal electrode 45. Accordingly, an external shape of the insulating adhesive 33 which has spread and further cured becomes substantially circular.

In the case of the first embodiment, the planar shape of the terminal electrode 10 is a rectangle, and therefore, when it is intended to diffuse the insulating adhesive 33 into four corners of the terminal electrode 10 as shown in FIG. 5, there may be the case where the insulating adhesive 33 protrudes outside the terminal electrode 10. In contrast to this, in the case of the second embodiment, a part of the external shape of the terminal electrode 45 is circular, and therefore, even if the insulating adhesive 33 in the same amount as in the first embodiment is applied, the insulating adhesive 33 is prevented from occurrence of protrusion outside the terminal electrode 45 as shown in FIG. 10. For that reason, the outward appearance of the antenna apparatus, particularly the connector portion becomes good, whereby a window glass with an excellent design is provided.

In the second embodiment, there is also obtained an effect the same as in the first embodiment such that an antenna apparatus having a joint portion of the connector having both good mechanical strength and electric characteristic can be realized. Furthermore, in the case of the second embodiment, since a part of the external shape of the terminal electrode 45 is circular, the insulating adhesive 33 is prevented from occurrence of protrusion outside the terminal electrode 45, and the outward appearance of the antenna apparatus, particularly the connector portion can be improved.

The technical scope of the present invention is not limited to the above-described embodiments, but it is possible to make various changes and modifications within the range where the gist of the present invention is not deviated.

For example, in the above-described embodiments, the pressure-sensitive adhesive double-coated tape functioning as a spacer and also as a temporarily fixing means is provided between the connector main body and the window glass; however, the pressure-sensitive adhesive double-coated tape may not be always provided. For example, a projection functioning as a spacer and having no adhesiveness may be provided on the first surface of the connector, while providing a temporarily fixing means separately from the projection. The dielectric substrate is not limited to a glass but may be a resin.

Besides, the specific descriptions regarding the shape, number, arrangement, material, and the like of the respective constituent elements of the antenna apparatus are not limited to those in the above-described embodiments, but it is possible to properly make changes and modifications therein. In the above-described embodiments, the signal-side terminal electrode and the earth-side terminal electrode have the same shape and same dimensions; however, for example, in order to increase binding properties, the shape or dimensions of the signal-side terminal electrode and the earth-side terminal electrode may be made different by enlarging only the earth-side terminal electrode or other means.

The present application is based on Japanese Patent Application No. 2015-181476 filed on Sep. 15, 2015, the contents of which are incorporated herein by reference.

It is possible to utilize the present invention as an antenna apparatus that is used for a window glass of a vehicle such as automobiles. The connector according to the present invention is utilized as a connector for a vehicular glass antenna which receives the digital terrestrial television broadcast (which uses frequencies ranging from 470 MHz to 862 MHz), and the UHF-band analog television broadcast, digital television broadcast, and digital radio broadcast (which use frequencies ranging from 170 MHz to 230 MHz) in Japan, South Korea, China, Brazil, the United States of America, Europe, and the like. Besides, the connector according to the present invention is utilized also as a connector for a vehicular glass antenna which receives the frequency-modulation (FM) band analog radio broadcast (which uses frequencies ranging from 76 MHz to 90 MHz) in Japan, the FM-band analog radio broadcast (which uses frequencies ranging from 88 MHz to 108 MHz) in the United States of America, and the VHF-band analog television broadcast (which uses frequencies ranging from 90 MHz to 108 MHz and from 170 MHz to 222 MHz). The connector according to the present invention is utilized also as a connector for a glass antenna which receives the broadcast and communication at frequencies in the 800 MHz band for mobile phones (which use frequencies ranging from 810 MHz to 960 MHz), the 1.5 GHz band for mobile phones (which use frequencies ranging from 1.429 GHz to 1.501 GHz), the 1.9 GHz band for mobile phones (which use frequencies ranging from 1.850 GHz to 1.990 GHz), the global positioning system (GPS) (which uses a frequency of 1,575.42 MHz), the vehicle information and communication system (VICS (a registered trademark)) (which uses a frequency of 2.5 GHz), the electronic toll collection system (ETC (non-stop automatic fare collection system)) (which uses frequencies of the 5.8 GHz band), the dedicated short range communication (DSRC) (which uses frequencies of the 915 MHz band and the 5.8 GHz band), communication for the automotive keyless entry system (which uses frequencies ranging from 300 MHz to 450 MHz), communication for the satellite digital audio radio service (SDARS) (which uses frequencies of the 2.3 GHz band and the 2.6 GHz band), and communication for the intelligent transport systems (ITS) (which uses frequencies of the 700 MHz band and the 5.9 GHz band). Thus, the connector according to the present invention can be utilized as a surface mounting type connector suitable for broadcast and communication using signals of a very high frequency (VHF) band (whose frequencies range from 30 MHz to 300 MHz), an ultrahigh frequency (UHF) band (whose frequencies range from 300 MHz to 3 GHz), and a microwave (SHF) band (whose frequencies range from 3 GHz to 30 GHz).

DESCRIPTION OF REFERENCE NUMERALS AND SIGNS

1: Antenna apparatus
2: Window glass (dielectric substrate)
3: Antenna
4: Connector
6: Antenna conductor
6A: Signal-side antenna conductor
6B: Earth-side antenna conductor
7: Feeding electrode
7A: Signal-side feeding electrode
7B: Earth-side feeding electrode
9: Connector main body
10: Terminal electrode
10A: Signal-side terminal electrode
10B: Earth-side terminal electrode
12: Holder portion
13: Pickup portion
33: Insulating adhesive
37: Pressure-sensitive adhesive double-coated tape (spacer)
K: Coaxial cable (feeding cable)

What is claimed is:

1. A vehicular antenna apparatus comprising:
a dielectric substrate;
an antenna provided to the dielectric substrate; and
a connector electrically connected to a feeding cable of a receiving apparatus,
wherein the antenna comprises an antenna conductor provided to the dielectric substrate, and a feeding electrode electrically connected to the antenna conductor and provided on a first surface of the dielectric substrate,
the connector comprises a connector main body supporting the feeding cable, and a terminal electrode provided to the connector main body and electrically connected to the feeding cable,
the feeding electrode and the terminal electrode are joined via an insulating adhesive, thereby being capacitively coupled with each other, and
the vehicular antenna apparatus further comprises, separate from the insulating adhesive, a spacer configured to maintain a gap between the connector and the dielectric substrate, the spacer being in direct contact with the dielectric substrate.

2. The vehicular antenna apparatus according to claim 1, wherein the connector comprises a holder portion having the terminal electrode, and a pickup portion detachably fitted to the holder portion and electrically connected to the feeding cable.

3. The vehicular antenna apparatus according to claim 1, wherein the spacer has adhesiveness.

4. The vehicular antenna apparatus according to claim 1, wherein the insulating adhesive has a dielectric constant of 4 or more.

5. The vehicular antenna apparatus according to claim 4, wherein the insulating adhesive has the dielectric constant of 10 or more.

6. The vehicular antenna apparatus according to claim 4, wherein the insulating adhesive contains carbon black.

7. The vehicular antenna apparatus according to claim 1, wherein the insulating adhesive has a volume resistivity of 104 Ω·m or more.

8. The vehicular antenna apparatus according to claim 7, wherein the insulating adhesive has the volume resistivity of 1012 Ω·m or more.

9. The vehicular antenna apparatus according to claim 1, wherein the insulating adhesive has a shear adhesive strength of 1.0 MPa or more.

10. The vehicular antenna apparatus according to claim 1, wherein the dielectric substrate is a laminated glass.

11. The vehicular antenna apparatus according to claim 1 further comprising:
a connector main body supporting a feeding cable; and
a terminal electrode provided on a first surface of the connector main body and electrically connected to the feeding cable,
wherein the first surface of the connector main body and a joint surface of the terminal electrode are positioned on the substantially same plane.

12. The vehicular antenna apparatus according to claim 11, wherein, when a direction where the connector main body and the terminal electrode stand is defined as a first direction, and a direction orthogonal to the first direction is defined as a second direction,
a dimension of the terminal electrode in the second direction when viewed from a normal direction of the first surface and a dimension of the connector main body in the second direction when viewed from the normal direction of the first surface are substantially equal to each other.

13. The vehicular antenna apparatus according to claim 11, wherein an external shape of the terminal electrode includes a curved portion.

14. The vehicular antenna apparatus according to claim 1, wherein the insulating adhesive is an adhesive of a type which is spontaneously cured.

15. The vehicular antenna apparatus according to claim 1, wherein the spacer is a pressure-sensitive adhesive double-coated tape.

16. The vehicular antenna apparatus according to claim 1, wherein the antenna conductor and the feeding electrode are both provided on the first surface of the dielectric substrate.

17. The vehicular antenna apparatus according to claim 1, wherein the feeding electrode and the terminal electrode are both provided on a same side of the dielectric substrate.

18. A vehicular antenna apparatus comprising:

a dielectric substrate;

an antenna provided to the dielectric substrate;

a connector electrically connectable to a feeding cable of a receiving apparatus; and a spacer configured to maintain a gap between the connector and the dielectric substrate and fix the connector and the dielectric substrate, wherein the antenna comprises an antenna conductor provided to the dielectric substrate, and a feeding electrode electrically connected to the antenna conductor and provided on a first surface of the dielectric substrate, the connector comprises a connector main body supporting the feeding cable, and a terminal electrode provided to the connector main body and electrically connectable to the feeding cable, the feeding electrode and the terminal electrode are joined via an insulating adhesive, thereby being capacitively coupled with each other, the insulating adhesive is an adhesive of a type which is spontaneously cured, a joint surface of the terminal electrode with the feeding electrode and a first surface of the connector main body as an opposing surface to the dielectric substrate are positioned on the substantially same plane, the spacer is a pressure-sensitive adhesive double-coated tape, and the pressure-sensitive adhesive double-coated tape is stuck onto the first surface of the connector main body.

* * * * *